United States Patent [19]

Grundmann et al.

[11] 4,269,040

[45] May 26, 1981

[54] HEAT PUMP DRIVE

[75] Inventors: Edgard Grundmann; Winfried Bernhardt, both of Wolfsburg, Fed. Rep. of Germany

[73] Assignee: Volkswagenwerk Aktiengesellschaft, Wolfsburg, Fed. Rep. of Germany

[21] Appl. No.: 11,668

[22] Filed: Feb. 12, 1979

[30] Foreign Application Priority Data

Feb. 17, 1978 [DE] Fed. Rep. of Germany ..... 2806729

[51] Int. Cl.[3] ..... F25B 43/02

[52] U.S. Cl. ..... 62/467 PR; 60/641 R

[58] Field of Search ..... 62/467, 238 C; 60/641

[56] References Cited

U.S. PATENT DOCUMENTS

| | | | |
|---|---|---|---|
| 3,630,040 | 12/1971 | Goldfarb | 62/5 |
| 4,094,146 | 6/1978 | Schweitzer | 60/641 |
| 4,110,986 | 5/1978 | Tacchi | 60/641 |

FOREIGN PATENT DOCUMENTS 2550413 5/1977 Fed. Rep. of Germany .

OTHER PUBLICATIONS

*Directly Fired Heat Pump for Domestic and Light Commercial Application,* Strong, D. T. G., 10/23–25, 1979.

*Primary Examiner*—Ronald C. Capossela
*Attorney, Agent, or Firm*—Spencer & Kaye

[57] ABSTRACT

A heat pump arrangement includes an evaporator, a first condenser and a compressor connected in a circuit containing a heat-carrying medium. The compressor is arranged downstream of the evaporator and the first condenser is arranged downstream of the compressor as viewed in the direction of the flow of the medium, whereby the compressor receives medium in the vapor phase from the evaporator and delivers medium in the liquid phase to the evaporator through the first condenser. The heat pump arrangement further has an expander, a second condenser connected downstream of the expander and a pump arranged between the output of the second condenser and the evaporator. The temperature in the first condenser which is designed for extracting useful heat is higher and the temperature in the second condenser is lower than the temperature in the evaporator and further, the expander which is driven by means of a first partial flow of the medium flowing from the evaporator is coupled in a force-transmitting manner with the pump as well as with the compressor for the remaining second partial flow of the medium flowing from the evaporator.

6 Claims, 2 Drawing Figures

HEAT PUMP DRIVE

BACKGROUND OF THE INVENTION

This invention relates to a heat pump arrangement which includes a circuit containing a heat-carrying medium, as well as an evaporator, a first condenser and a compressor connected in the circuit. The compressor is arranged in the circuit downstream of the evaporator as viewed in the direction of the flow of the medium and recirculates the medium through the first condenser to the evaporator.

In the broad sense, heat pump arrangements of the above-outlined type serve for generating a useful temperature from a lower temperature difference.

It is a desideratum, particularly when the above-noted temperature difference is small, to drive the heat pump arrangement with as little external energy input as possible. In known heat pump arrangements, the compressor is driven by external energy, for example, by an internal combustion engine or an electromotor.

SUMMARY OF THE INVENTION

It is an object of the invention to provide an improved heat pump arrangement of the above-outlined type which needs no external energy for its operation. This, it is noted, does not mean the application of an energy derived from the above-noted temperature difference, but an additional mechanical drive energy.

This object and others to become apparent as the specification progresses, are accomplished by the invention, according to which, briefly stated, the heat pump arrangement further has an expander, a second condenser connected downstream of the expander as viewed in the direction of the flow of the medium and a pump arranged between the output of the second condenser and the evaporator. The temperature in the first condenser which is designed for extracting useful heat is higher and the temperature in the second condenser is lower than the temperature in the evaporator and further, the expander which is driven by means of a first partial flow of the medium flowing from the evaporator is coupled in a force-transmitting manner with the pump as well as with the compressor for the remaining second partial flow of the medium flowing from the evaporator.

Thus, according to the invention, the heat-carrying medium, such as a conventionally used coolant, for example, a halogenized hydrocarbon, is itself divided downstream of the evaporator, thus in the vapor phase, into two partial streams. The first partial stream is admitted to the expander for driving it to perform its expansion function, whereas the second partial stream is admitted to the compressor. The expander, the compressor and the pump are drivingly connected to one another, so that all three devices are driven by the first partial stream of the heat-carrying medium. Thus, the application of an external driving energy is dispensed with.

The mechanical energy derived in the expander from the first partial stream of the heat-carrying medium admitted in the vapor phase, thus has to be equal—apart from frictional and heat transfer losses—to the sum of the energy necessary for the densification of the second partial stream in the compressor plus the energy which is necessary for driving the pump and which is to be introduced into the pump. The energy required for the compressor is ultimately dependent from the temperature difference between the first condenser at which the useful heat is taken and the evaporator, while the magnitude of the driving energy for the pump is in essence determined by the pressure difference between the evaporator and the second condenser.

In principle it is feasible to design both the expander and the compressor as piston-and-cylinder assemblies. Taking into consideration the required driving connection also with the pump, it is, however, more advantageous to provide that the expander and the compressor are of the rotary type. In such a case the expander and the compressor themselves execute rotary motions which may be converted into driving displacements for the pump, for example, by means of a cam disc mounted on a shaft which is common to the expander and the compressor. The expander and the compressor may be of the turbine type; it is particularly expedient, however, to use a screw-type expander and a screw-type compressor since such structures are capable of generating large pressure differences even in case of non-constant operational conditions.

DESCRIPTION OF THE PREFERRED EMBODIMENT

Figure 1:
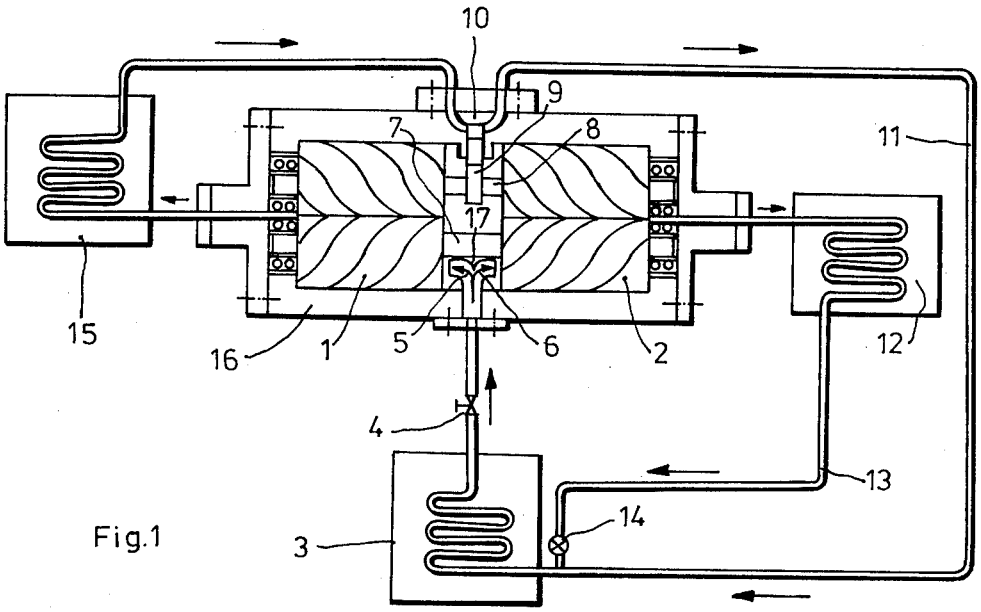
FIG. 1 is a schematic view of a heat pump arrangement according to a preferred embodiment of the invention.

Turning now to FIG. 1, there is shown an expander 1 and a compressor 2 which receive the heat-carrying medium exiting in the vapor phase from an evaporator 3. Both the expander and the compressor are of the screw type. Such arrangements are conventional by themselves; they are disclosed, for example, in U.S. Pat. No. 3,630,040. After passing through a shutoff valve 4, the vaporized heat-carrying medium is divided into a first partial stream 5 and a second partial stream 6 by means of a conventional stream splitter 17. The first partial stream 5 is admitted to the expander 1 for driving the same. The expander 1 and the compressor 2 are coupled by two shafts 7 and 8 in the sense of transferring the driving motions. On the shaft 8 there is mounted a cam 9 which converts the rotary motions of the shaft 8 into driving motions for the pump 10. Thus, the first partial stream 5 of the heat-carrying medium drives the expander 1, the compressor 2 and the pump 10 for the heat-carrying medium which has to be returned in the liquid phase through the return conduit 11 to the evaporator 3.

The heat-carrying medium which forms the second partial stream 6 and which is compressed in the compressor 2, is admitted into the first condenser 12 which, for extracting useful heat, may be designed as a heat exchanger and then the heat-carrying medium is returned to the inlet of the evaporator 3 in the liquid phase through a conduit 13 and an injection valve 14. Instead of an injection valve any other device may find application which is adapted to maintain the pressure difference between the first condenser 12 and the evaporator 3.

The pump 10 serves for returning the first partial stream 5—again liquified in the second condenser 15—to the inlet of the evaporator 3.

The expander 1, the compressor 2 and the pump 10 are arranged in a common housing 16, whose seals may be of particularly simple structure, because none of the moving parts project out of the housing 16.

Figure 2:
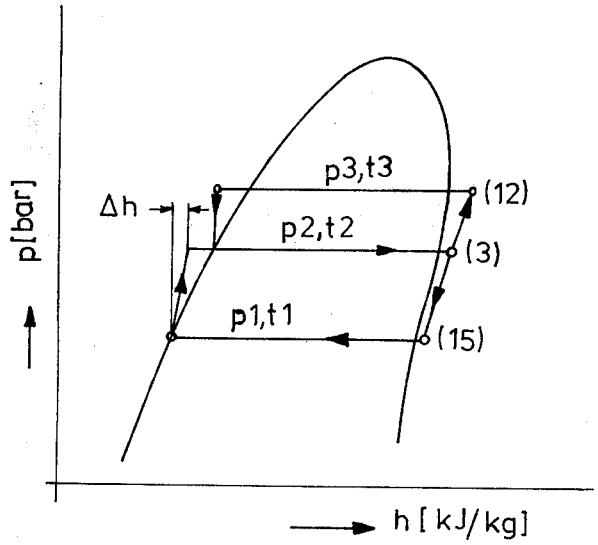
FIG. 2 is a diagram pertaining to the operation of the preferred embodiment.

Turning now to the diagram illustrated in FIG. 2, there is shown the course of the pressure p of the heat-carrying medium as a function of the enthalpy h. The lower quadrilateral curve shows the behavior of the first partial stream 5 which, as was explained above, serves for driving the expander 1, whereas the upper quadrilateral curve illustrates the behavior of the second partial stream 6. In parantheses there are shown the reference numerals of those components of the heat pump arrangement illustrated in FIG. 1 which are associated with the point on the curves situated next to the numeral. The curves progress in the direction of the arrows. p1, p2 and p3 are the pressure valves and t1, t2 and t3 are the temperature valves of the heat-carrying medium in the second condenser 15, in the evaporator 3 and in the first condenser 12, respectively. The pressure and the temperature thus vary in the same sense in this sequence. There is further shown the enthalpy difference Δh which is a measure of the energy to be applied to the liquid pump 10.

The division of the heat-carrying medium into the two streams 5 and 6 as well as the arrangement particularly of the expander, the compressor and the pump have to be such that the enthalpy difference between the points (3) and (15) on the diagram is identical to the enthalpy difference between the points (3) and (12) of the diagram, plus the enthalpy difference Δh, while an addition for losses has to be taken into account. The energy to be applied to the pump, that is, the enthalpy difference Δh is independent from the difference between the pressures p1 and p2, since the pump has to bring the liquid working medium in the return conduit 11 from the pressure p1 in the second condenser 15 to the pressure p2 in the evaporator 3.

In the description which follows, the mode of operation of the entire heat pump arrangement will be summarized with reference to the diagram of FIG. 2.

The heat-carrying medium, for example, a halogenized hydrocarbon or another liquid of low boiling point is evaporated in the evaporator 3 by means of heat admission thereto, so that it has a temperature t2 at a pressure p2. The first partial stream 5 expands in the expander 1 and drives the latter, as well as the compressor 2 and the pump 10 and is admitted into the second condenser 15 which may also be designated as a source of refrigeration. In the second condenser 15 the heat-carrying medium assumes the temperature t1 and the pressure p1. THe pump 10 delivers the again liquified heat-carrying medium from the second condenser 15 back into the evaporator 3 while its pressure is increased from p1 to p2.

The second partial stream 6 of the heat-carrying medium, on the other hand, is admitted into the compressor 2 and therefrom into the first condenser 12 where it is condensed while it releases condensation heat and assumes the temperature value t3 and the pressure value p3. The liquid heat-carrying medium is, through the conduit 13, admitted to the evaporator 3 as well; during this occurrence the injection valve 14 maintains the difference between the pressures p3 and p2.

It is an advantage of the compact structure of the described preferred embodiment that is is free from sealing problems, since the moving components within the housing 16 need not be accessible from the outside during operation, because the energy required for driving the expander, the compressor and the liquid pump are directly derived from the heat-carrying medium circulating within the system.

It is to be understood that the above description of the present invention is susceptible to various modifications, changes and adaptations and the same are intended to be comprehended within the meaning and range of equivalents of the appended claims.

What is claimed is:

1. In a heat pump arrangement including an evaporator, a first condenser and a compressor connected in a circuit containing a heat-carrying medium and each having an inlet and an outlet; the compressor being arranged downstream of the evaporator and the first condenser being arranged downstream of the compressor as viewed in the direction of the flow of the medium, whereby the compressor receives medium in the vapor phase from the outlet of the evaporator and delivers medium in the liquid phase to the inlet of the evaporator through the first condenser; the improvement comprising an expander having an inlet coupled to the outlet of said evaporator; medium splitting means situated between the outlet of said evaporator and the inlet of said expander and said compressor for dividing the vaporized medium exiting from said evaporator into a first partial stream and a second partial stream; said first partial stream being introduced into said expander for driving said expander; a second condenser having an inlet coupled to the outlet of said expander for receiving medium therefrom; a pump having an inlet coupled with the outlet of said second condenser and an outlet coupled with the inlet of said evaporator; force-transmitting means connecting said expander with said compressor and said pump for driving said compressor and said pump from said expander energized by said first partial stream; said second partial stream being introduced into said compressor; and further wherein said first condenser is arranged for extracting useful heat from said second partial stream and the temperature of the medium exiting from said first condenser is higher than and the temperature of the medium exiting from said second condensor is lower than the temperature of the medium exiting from said evaporator.

2. A heat pump arrangement as defined in claim 1, wherein said expander and said compressor are of the rotary type.

3. A heat pump arrangement as defined in claim 2, wherein said expander and said compressor are of the screw type.

4. A heat pump arrangement as defined in claim 1, further comprising a common housing for accommodating said expander, said compressor and said pump.

5. A heat pump arrangement as defined in claim 1, further comprising means connected between the outlet of said first condenser and the inlet of said evaporator for maintaining a pressure difference between said first condenser and said evaporator.

6. A heat pump arrangement as defined in claim 5, wherein said means for maintaining said pressure difference is an injection valve.

* * * * *